US010506319B2

(12) United States Patent
Chang et al.

(10) Patent No.: US 10,506,319 B2
(45) Date of Patent: Dec. 10, 2019

(54) AUDIO ELECTRONIC DEVICE AND AN OPERATING METHOD THEREOF

(71) Applicants: INVENTEC APPLIANCES (PUDONG) CORPORATION, Shanghai (CN); INVENTEC APPLIANCES CORP., New Taipei (TW)

(72) Inventors: Wen-Ching Chang, New Taipei (TW); Tung-Yueh Shen, New Taipei (TW)

(73) Assignees: INVENTEC APPLIANCES (PUDONG) CORPORATION, Shanghai (CN); INVENTEC APPLIANCES CORP., New Taipei (TW)

( * ) Notice: Subject to any disclaimer, the term of this patent is extended or adjusted under 35 U.S.C. 154(b) by 0 days.

(21) Appl. No.: 15/628,845

(22) Filed: Jun. 21, 2017

(65) Prior Publication Data

US 2018/0295440 A1 Oct. 11, 2018

(30) Foreign Application Priority Data

Apr. 11, 2017 (CN) ..... 2017 1 0233008

(51) Int. Cl.
*H04R 1/10* (2006.01)
*H04R 1/02* (2006.01)

(52) U.S. Cl.
CPC ..... *H04R 1/1016* (2013.01); *H04R 1/023* (2013.01); *H04R 1/1066* (2013.01); *H04R 1/1075* (2013.01); *H04R 1/1083* (2013.01); *H04R 2201/029* (2013.01); *H04R 2420/07* (2013.01); *H04R 2460/07* (2013.01)

(58) Field of Classification Search
CPC .... H04R 25/65–658; H04R 1/10–1091; H04R 2201/10–109
See application file for complete search history.

(56) References Cited

U.S. PATENT DOCUMENTS 8,891,793 B1 * 11/2014 Sacha ..... H04R 25/558 381/312
2014/0233774 A1 * 8/2014 Kim ..... H04R 25/30 381/315
2016/0004283 A1 * 1/2016 Ganguly ..... G06F 1/1656 307/118
2016/0337766 A1 * 11/2016 Flaig ..... H04R 25/658
2018/0027343 A1 * 1/2018 Dobson ..... H01Q 1/2208 381/322

* cited by examiner

*Primary Examiner* — Joshua Kaufman
(74) *Attorney, Agent, or Firm* — McClure, Qualey & Rodack, LLP

(57) ABSTRACT

An audio electronic device including a front structure and a rear structure is provided. The front structure includes an embedded body and a speaker, wherein the speaker is connected to the embedded body, and the embedded body is inserted in an ear. The rear structure is connected to the front structure and includes a processor, a receiver, and a power supply, wherein the processor is electrically connected to the speaker and processes an audio signal according to the judgment signal, and the receiver is used for receiving a judgment signal.

8 Claims, 6 Drawing Sheets

AUDIO ELECTRONIC DEVICE AND AN OPERATING METHOD THEREOF

This application claims the benefit of People's Republic of China application Serial No. 201710233008.6, filed Apr. 11, 2017, the subject matter of which is incorporated herein by reference.

BACKGROUND OF THE INVENTION

Field of the Invention

The invention relates in general to an audio electronic device, and more particularly to an audio electronic device equipped with an embedded body.

Description of the Related Art

Recently, people's demand for audio devices (such as earplugs and headsets) gradually increases. When the user of an audio device changes his/her environment, place or activity, a conventional audio device having simple functions cannot meet users' various requirements. Therefore, how to provide an audio device capable of meeting users' various requirements has become a prominent task in the industry.

SUMMARY OF THE INVENTION

The invention is directed to an audio electronic device and an operating method thereof capable of resolving at least some of the problems disclosed above.

According to one embodiment of the present invention, an audio electronic device including a front structure and a rear structure is provided. The front structure includes an embedded body and a speaker, wherein the speaker is connected to the embedded body, and the embedded body is inserted in an ear. The rear structure is connected to the front structure and includes a processor, a receiver, and a power supply, wherein the processor is electrically connected to the speaker and processes an audio signal according to the judgment signal, and the receiver is used for receiving a judgment signal.

According to another embodiment of the present invention, the operating method of an audio electronic device includes: receiving a judgment signal by a receiver; receiving an audio signal by a microphone; and processing the audio signal by a processor according to the judgment signal to determine the mode under which the audio signal is transmitted to the speaker.

According to an alternate embodiment of the present invention, the operating method of an audio electronic device includes: receiving a judgment signal using a receiver; and processing the audio signal according to the judgment signal by a processor to determine the mode under which the audio signal is transmitted to the speaker.

The above and other aspects of the invention will become better understood with regard to the following detailed description of the preferred but non-limiting embodiment (s). The following description is made with reference to the accompanying drawings.

DETAILED DESCRIPTION OF THE INVENTION

Figure 1:
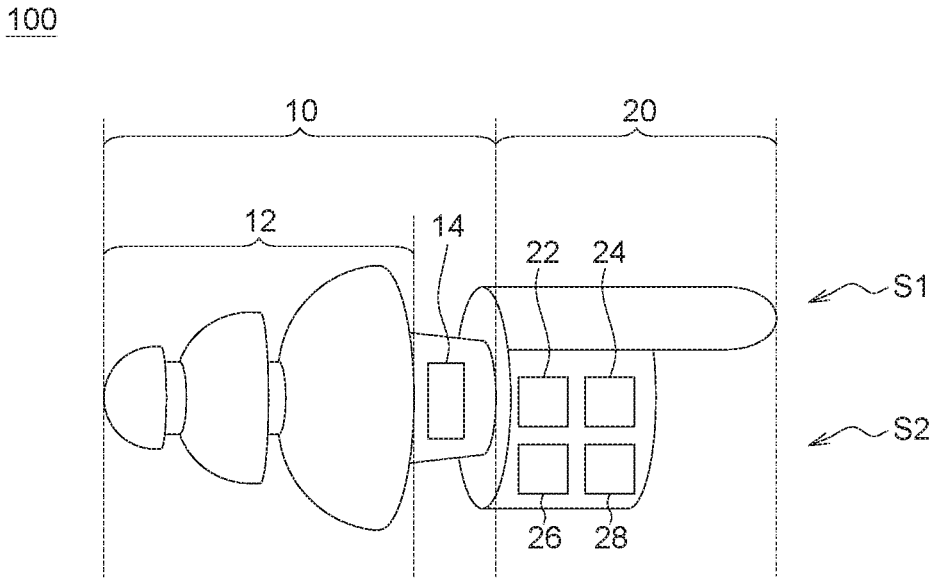
FIG. 1 is a schematic diagram of an audio electronic device according to an embodiment of the present disclosure.
Figure 2:
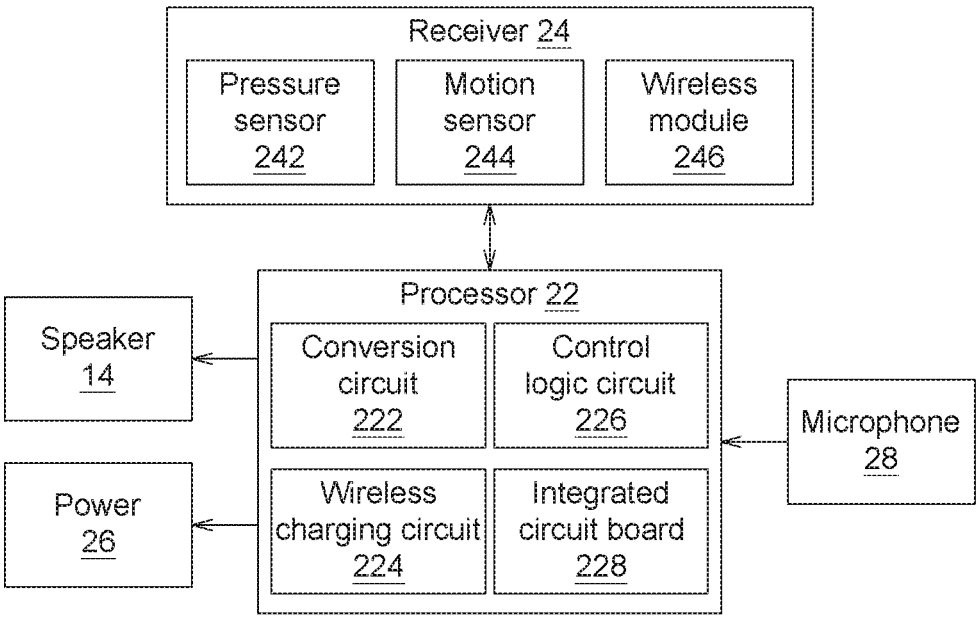
FIG. 2 is an electronic block diagram of an audio electronic device according to an embodiment of the present disclosure.
Figure 3:
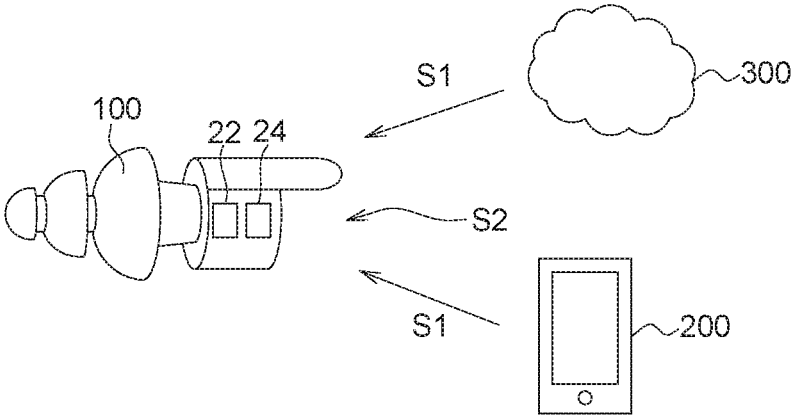
FIG. 3 is a schematic diagram of an audio electronic device receiving a wireless signal according to an embodiment of the present disclosure.

FIG. 1 is a schematic diagram of an audio electronic device according to an embodiment of the present disclosure. FIG. 2 is an electronic block diagram of an audio electronic device according to an embodiment of the present disclosure. FIG. 3 is a schematic diagram of an audio electronic device receiving a wireless signal according to an embodiment of the present disclosure.

Refer to FIG. 1. The audio electronic device 100 includes a front structure 10 and a rear structure 20. The front structure 10 and the rear structure 20 are interconnected. The front structure 10 includes an embedded body 12 and a speaker 14. The speaker 14 is connected to the embedded body 12. The embedded body 12 is inserted in an ear. For example, the embedded body 12 can be used as an earplug to avoid water and noises entering the ear canal. The embedded body 12 can be realized by a replaceable rubber ring.

The rear structure 20 includes a processor 22, a receiver 24, and a power supply 26. The processor 22 is electrically connected to the speaker 14. The receiver 24 is used for receiving a judgment signal S1. The processor 22 processes an audio signal S2 according to the judgment signal S1. For example, the processor 22 determines whether the audio signal S2 is transmitted to the speaker 14 according to the judgment signal S1. If the audio signal S2 can be transmitted to the speaker 14, then the speaker 14 converts the audio signal S2 to a sound wave into the user's ear.

Refer to FIGS. 1 and 2. The processor 22 can be realized by a central processor or a microprocessor used for performing data computing or controlling peripheral units. The processor 22 includes a conversion circuit 222, a wireless charging circuit 224, a control logic circuit 226, and an integrated circuit board 228. The conversion circuit 222 switches the mode of the speaker 14 according to the judgment signal S1. The wireless charging circuit 224 performs wireless charging on the power supply 26. The power supply 26 can be realized by a rechargeable battery.

In an embodiment, the rear structure 20 includes a microphone 28 used for receiving an audio signal S2. It should be noted that the invention is not limited thereto. In other embodiments, the rear structure 20 does not have to include the microphone 28. Or, regardless whether the rear structure 20 includes the microphone 28 or not, the audio signal S2 can be received by the receiver 24 instead of the microphone 28. Besides, the microphone 28 can be realized by a waterproof microphone.

In an embodiment, the front structure 10 and the rear structure 20 can be wrapped by a waterproof material. The waterproof material can be realized by a waterproof foam or a waterproof breathable film. The waterproof material includes a microporous structure whose aperture is, for example, between 0.2-20 microns (μm). Since the front structure 10 and the rear structure 20 are wrapped by a waterproof material, water molecules and dusts cannot penetrate the waterproof material to enter the front structure 10 and the rear structure 20. Therefore, electronic materials of the audio electronic device 100 (such as microphone, receiver, processor, power supply, and speaker) are protected by the waterproof material.

In an embodiment, the judgment signal S1 can be realized by an environmental signal, a wireless signal or a physiological signal. For example, the environmental signal represents pressure, temperature, humidity and so on. The wireless signal is generated by, for example, an electronic device equipped with a Bluetooth module, a Wi-Fi module or an IoT module. The physiological signal represents such as heart beat, body temperature, body motion and so on.

In an embodiment, the receiver 24 can include a pressure sensor 242. When the judgment signal S1 represents pressure, the pressure sensor 242 detects whether the pressure is greater than 1 atm, and the processor 22 checks whether the audio electronic device 100 is under the water according to the judgment signal S1 and further processes the audio signal S2 according to the judgment signal S1. For example, the conversion circuit 222 switches the speaker 14 to a "mute mode" or a "loudspeaker mode". Under the "mute mode", the audio signal S1 cannot be transmitted to the speaker 14 by the microphone 28 or the receiver 24. Under the "loudspeaker mode", the audio signal S2 can be transmitted to the speaker 14 by the microphone 28 or the receiver 24. Thus, the audio electronic device 100 can automatically switch the mode of the speaker 14 without bothering the user to manually switch the mode, and therefore provides better convenience than conventional audio electronic devices. Unlike the user wearing a conventional earplug who has surface and unplug the earplug with his/her wet hand before the talk and has to plug the earplug again after the talk finishes, the user wearing the audio electronic device 100 can surface and talk directly without having to unplug and plug the earplug, and do the water activity cheerfully. Thus, during the water activity, the user wearing the audio electronic device 100 of the present disclosure can avoid repeating the process of plugging and unplugging the earplug when the user wants to talk.

In an embodiment, the receiver 24 includes a motion sensor 244. When the judgment signal S1 represents the user's moving speed, the processor 22 determines whether the user is doing sport or not, and further adjusts the mode (such as the "sport mode") under which the audio signal S2 is transmitted to the speaker 14 by the microphone 28 or the receiver 24. In an embodiment, the sport mode can be realized by a mute mode, which allows the user to enjoy a quiet environment during the sport without being interfered with by external sound waves. In an embodiment, the sport mode can be realized by a noise reduction mode. For example, under the sport mode, the processor 22 can generate an inverse sound wave against a sound wave of noises to reduce the sound wave of noises and filter off environmental noises to avoid unnecessary sound waves disturbing the user doing sport.

In an embodiment, the receiver 24 may include a wireless module 246, which can be realized by a Bluetooth module, a Wi-Fi module or an IoT module. In an embodiment, the receiver 24 may include the Bluetooth module, the Wi-Fi module and the IoT module at the same time. In an embodiment, the receiver 24 includes any two of the Bluetooth module, the Wi-Fi module and the IoT module.

Refer to FIG. 3. When the receiver 24 of the audio electronic device 100 includes the wireless module 246, the receiver 24 detects whether the judgment signal S1 includes a wireless signal emitted from a remote server 300 (such as a cloud) or an external electronic device 200 (such as a mobile phone or a computer) equipped with Bluetooth module, Wi-Fi module or IoT module. The processor 22 determines the mode under which the audio signal S2 is transmitted to the speaker 14 according to the judgment signal S1 (the wireless signal). For example, the processor 22 notifies the user of the message sent by the external electronic device 200 or the remote server 300 or adjusts the sound to a suitable working mode according to the location of the audio electronic device 100 (such as home, office, country side, cinema, crowd, or factory). For example, the location of the audio electronic device 100 can be obtained from the calendar information of the external electronic device 200 or the remote server 300, the global positioning system (GPS) signal, or any other positioning information (such as combined with the map information). For example, the location of the audio electronic device 100 can be obtained from the map information or from a particular time of the calendar information.

Figure 4:
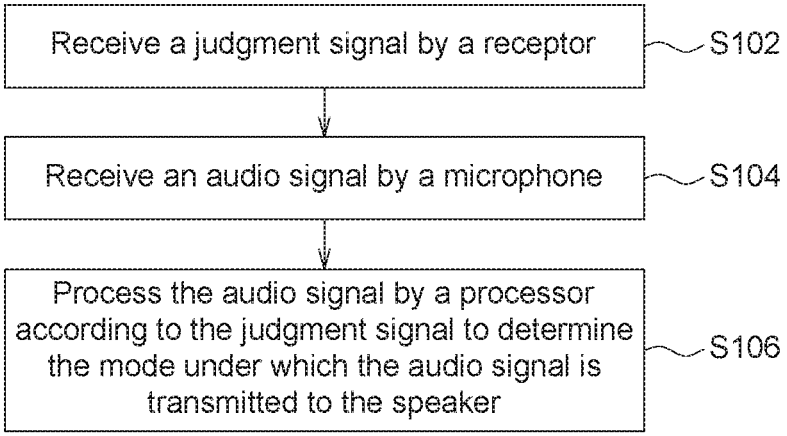
FIG. 4 is a flowchart of an operating method of an audio electronic device according to an embodiment of the present disclosure.

FIG. 4 is a flowchart of an operating method of an audio electronic device according to an embodiment of the present disclosure. Refer to FIG. 4. In step S102, a judgment signal S1 is received by an audio electronic device 100 using a receiver 24. In step S104, an audio signal S2 is received by the audio electronic device 100 using a microphone 28. Steps S102 and S104 can be performed concurrently, and the order of the two steps does not matter. In step S106, the audio signal S2 is processed by the audio electronic device 100 according to the judgment signal S1 using a processor 22 to determine the mode under which the audio signal S2 is transmitted to the speaker 14. As disclosed above, the judgment signal S1 includes an environmental signal, a wireless signal or a physiological signal. In the present embodiment, the audio electronic device 100 includes a microphone 28, and the audio signal S2 is received by the microphone 28, but the present disclosure is not limited thereto. In an embodiment, the audio electronic device 100 does not have to include the microphone 28, and the audio signal S2 is transmitted to the speaker 14 by the receiver 24. Or, after the judgment signal S1 is received by the receiver 24, the audio signal S2 (such as prompt sound effect) is generated and transmitted to the speaker 14 by the processor 22.

Figure 5:
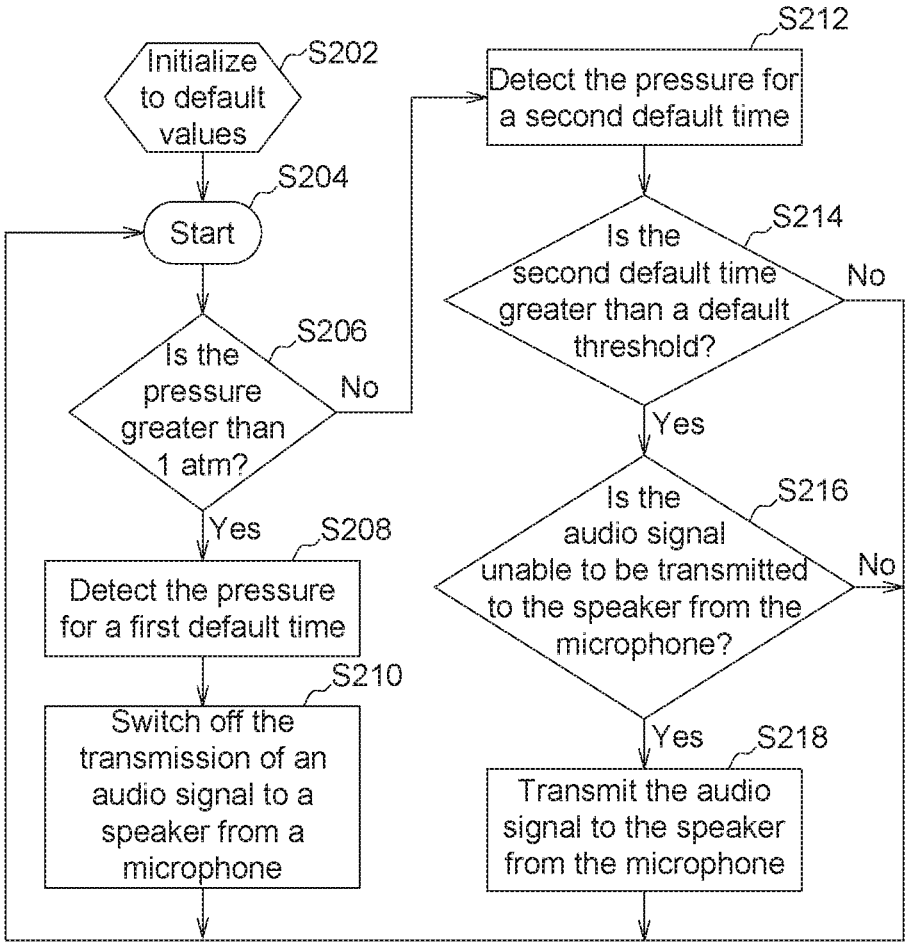
FIG. 5 is a flowchart of an operating method of an audio electronic device according to an embodiment of the present disclosure.

FIG. 5 is a flowchart of an operating method of an audio electronic device according to an embodiment of the present disclosure. In the present embodiment, the detection of the pressure sensor 242 is included in the operating method of the audio electronic device 100. Refer to FIG. 5. In step S202, an audio electronic device 100 is initialized to default values. In step S204, the audio electronic device 100 is started. In step S206, a pressure at the location of the audio electronic device 100 is detected by a pressure sensor 242, and whether the pressure is greater than 1 atmospheric pressure (atm) is determined. If the pressure detected by the pressure sensor 242 is greater than 1 atm, it is implied that the audio electronic device 100 is very likely to be in the water, and the method proceeds to step S208. If the pressure detected by the pressure sensor 242 is not greater than 1 atm (that is, the pressure is less than or equivalent to 1 atm), it is implied that the audio electronic device 100 may not be in the water, and the method proceeds to step S212.

In step S208, the pressure is detected by the pressure sensor 242 for a first default time (such as 0 second, 0.1 second, 0.3 second, 0.5 second, 0.7 second, or any time duration less than 3 seconds). After the first default time elapses, the processor 22 immediately switches a speaker 14 to a "mute mode" using a conversion circuit 222. In step S210, the transmission of the audio signal S1 to the speaker 14 from a microphone 28 is switched off by a processor 22 (the mute mode).

In step S212, the pressure is detected by the pressure sensor 242 for a second default time. For example, the second default time greater than the first default time. However, the present disclosure is not limited thereto, and the user can self-define the first default time and the second default time.

In step S214, whether the second default time is greater than a default threshold, such as 3 seconds, is determined. If the second default time is greater than the default threshold, it is implied that the audio electronic device 100 is not in the water, and the method proceeds to step S216. If the second default time is not greater than the default threshold, it cannot be concluded that the audio electronic device 100 is not in the water, and the method returns to step S204.

In step S216, whether the audio signal S2 is unable to be transmitted to the speaker 14 from the microphone 28 is determined. If the audio signal S2 cannot be transmitted to the speaker 14 by the microphone 28, then the method proceeds to step S218. If the audio signal S2 can be transmitted to the speaker 14 by the microphone 28, then the method returns to step S204. In step S218, the audio signal S2 is enable to be transmitted to the speaker 14 from the microphone 28 by the processor 22.

For example, during the transmission of the audio signal S2 to the speaker 14 form the microphone 28, the processor 22 can switch the speaker 14 to a "loudspeaker mode" using the conversion circuit 222. Under the "loudspeaker mode", the audio signal S2 can be transmitted to the speaker 14 by the microphone 28. After the audio signal S2 is converted to a sound wave by the speaker 14, the sound wave further is transmitted to the user's ear through the embedded body 12. Unlike the user wearing a conventional earplug who has surface and unplug the earplug with his/her wet hand before the talk and has to plug the earplug again after the talk finishes, the user wearing the audio electronic device 100 can surface and talk directly without having to unplug and plug the earplug, and do the water activity cheerfully. Thus, during the water activity, the user wearing the audio electronic device 100 of the present disclosure can avoid repeating the process of plugging and unplugging the earplug when the user wants to talk.

Moreover, the audio electronic device 100 of the present disclosure includes a processor 22 and a receiver 24, wherein the processor 22 automatically detects the environment of the audio electronic device 100 according to the judgment signal S1 received using the receiver 24, and further processes the audio signal S2 according to the judgment signal S1. For example, the processor 22 determines whether to transmit the audio signal S2 to the speaker 14. Thus, the audio electronic device 100 can automatically switch the mode of the speaker 14 without bothering the user to switch the mode manually, hence providing better convenience than conventional audio electronic devices.

Figure 6:
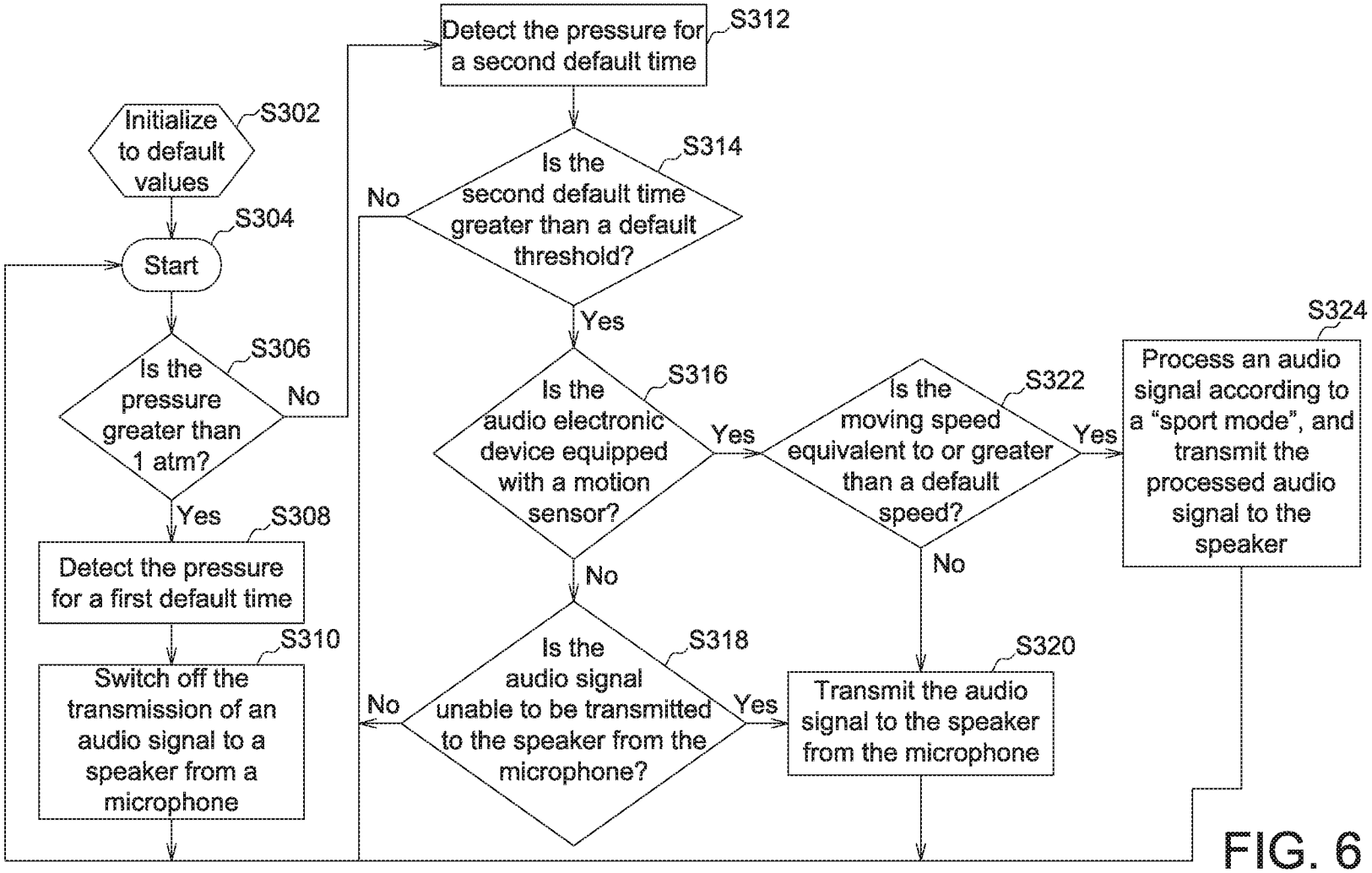
FIG. 6 is a flowchart of an operating method of an audio electronic device according to an embodiment of the present disclosure.

FIG. 6 is a flowchart of an operating method of an audio electronic device according to an embodiment of the present disclosure. Refer to FIG. 6. Since steps S302, S304, S306, S308, S310, S312, S314, S318 and S320 are similar to step S202, S204, S208, S210, S212, S214, S216 and S218, the similarities are not repeated here.

In step S316, whether the audio electronic device 100 is equipped with a motion sensor 244 is determined by the processor 22. If the audio electronic device 100 is equipped with a motion sensor 244, then the method proceeds to step S322. If the audio electronic device 100 is not equipped with a motion sensor 244, then the method proceeds to step S318.

In step S322, whether the moving speed of the audio electronic device 100 is equivalent to or greater than a default speed (such as 6 Km/hour) is determined. If the moving speed of the audio electronic device 100 is equivalent to or greater than the default speed, then the method proceeds to step S324. If the moving speed of the audio electronic device 100 is less than the default speed, then the method proceeds to step S320.

In step S324, after the audio signal S2 is processed by the processor 22 according to a "sport mode", the processed audio signal is transmitted to the speaker 14. If the moving speed of the audio electronic device 100 being greater than a default speed (such as 6 Km/hour), it is implied that the user possibly is doing sport (such as jogging), and the processor 22 can adjust the mode (such as the "sport mode") under which the audio signal S2 is transmitted to the speaker 14 by the microphone 28 or the receiver 24. In an embodiment, the sport mode can be realized by a mute mode, which allows the user to enjoy a quiet environment during sport without being interfered with by external sound waves. In an embodiment, the sport mode can be realized by a noise reduction mode. For example, under the sport mode, the processor 22 can generate an inverse sound wave against a sound wave of noises to reduce the sound wave of noises and filter off environmental noises to avoid unnecessary sound waves disturbing the user doing sport.

In the present embodiment, the detection of the pressure sensor 242 and the motion sensor 244 is included in the operating method of the audio electronic device 100. However, the present disclosure is not limited thereto. In some embodiments, the audio electronic device 100 does not include the pressure sensor 242. That is, step S316 can be performed immediately after step S304, and the steps between S304 and S316 can be omitted.

Figure 7A:
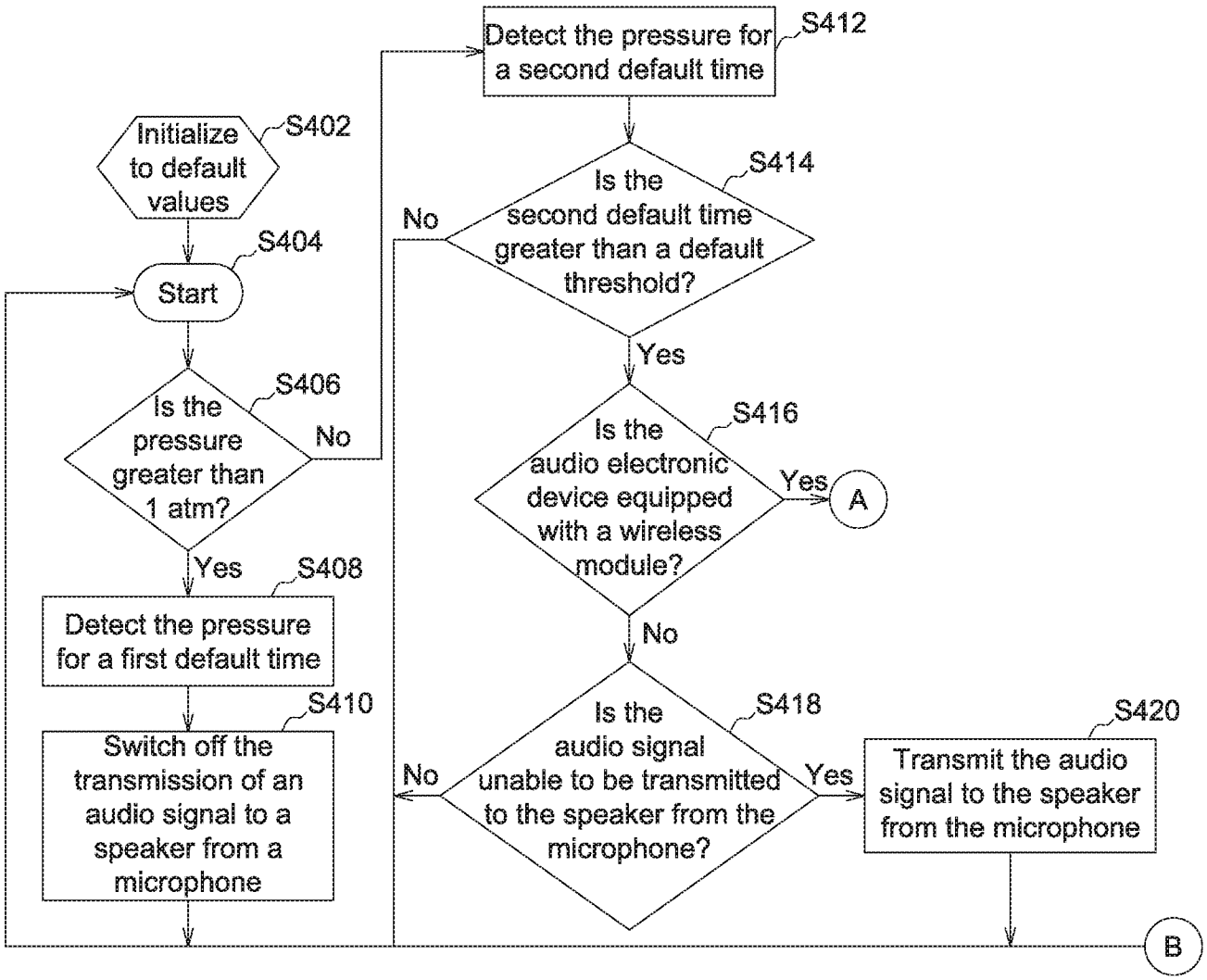
FIG. 7A is a partial flowchart of an operating method of an audio electronic device according to an embodiment of the present disclosure.
Figure 7B:
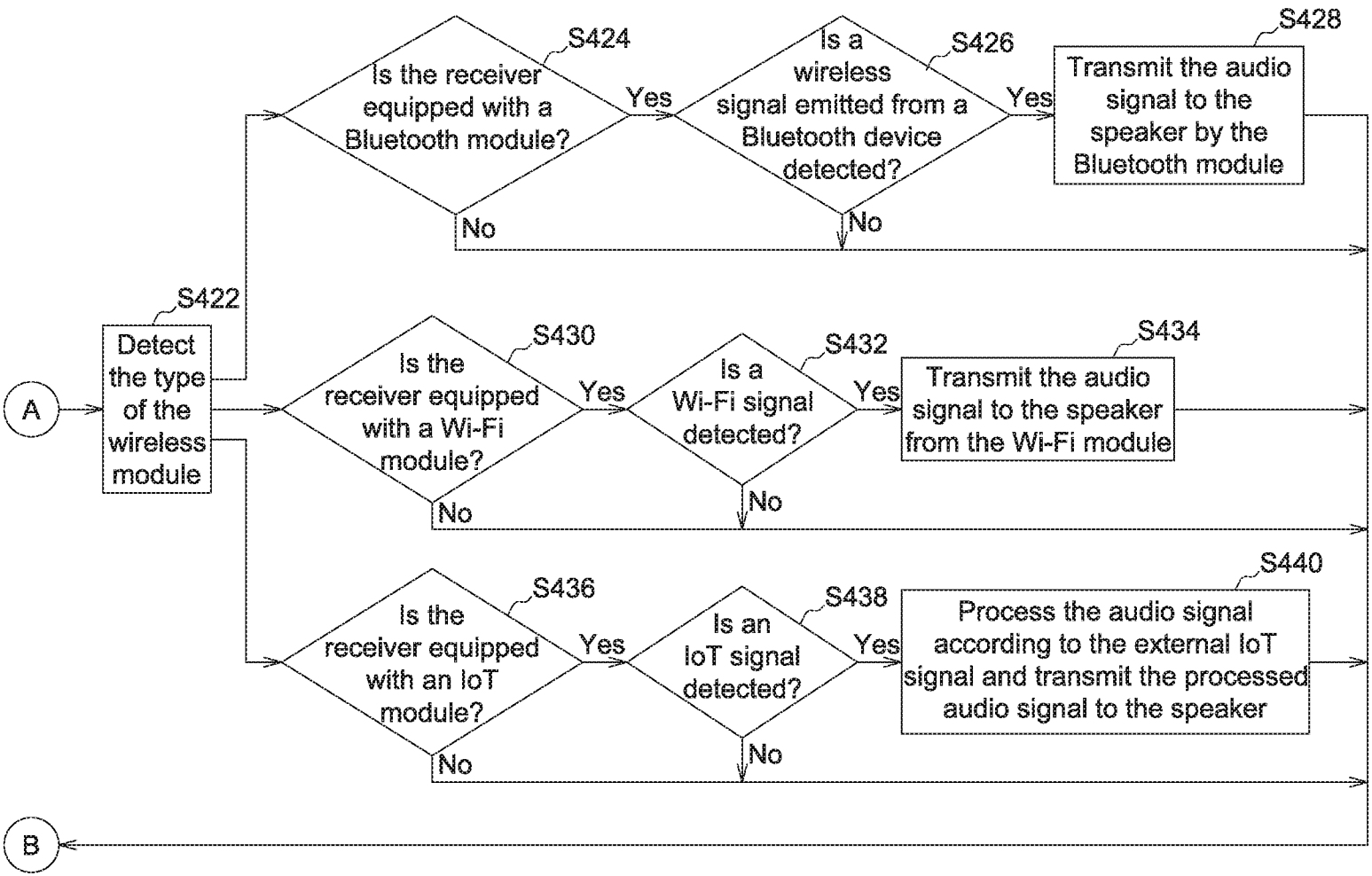
FIG. 7B is a continual partial flowchart of the operating method of an audio electronic device of FIG. 7A according to an embodiment of the present disclosure.

FIG. 7A is a partial flowchart of an operating method of an audio electronic device according to an embodiment of the present disclosure. FIG. 7B is a continual partial flowchart of the operating method of an audio electronic device of FIG. 7A according to an embodiment of the present disclosure. The endpoint A of FIG. 7A is connected to the endpoint A of FIG. 7B, and the endpoint B of FIG. 7B is connected to the endpoint B of FIG. 7A. Refer to FIG. 7A. Since steps S402, S404, S406, S408, S410, S412, S414, S418 and S420 are similar to step S202, S204, S208, S210, S212, S214, S216 and S218, the similarities are not repeated here.

In step S416, whether the audio electronic device 100 is equipped with a wireless module 246 is determined by the processor 22. If the audio electronic device 100 is equipped with a wireless module 246, then the method proceeds to step S422. If the audio electronic device 100 is not equipped with a wireless module 246, then the method proceeds to step S418.

In step S422, the type of the wireless module 246 is detected by the processor 22, and the method proceeds to step S424, S430, or S436. In an embodiment, steps S424, S430, and S436 can be performed concurrently, sequentially, or according to a predetermined order.

In step S424, whether the receiver 24 is equipped with a Bluetooth module is detected by the processor 22. If the receiver 24 is equipped with a Bluetooth module, then the method proceeds to step S426. If the receiver 24 is not equipped with a Bluetooth module, then the method proceeds to step S404.

In step S426, whether a wireless signal (conforming to Bluetooth advance audio distribution profile (A2DP), cordless telephony profile (CTP), Bluetooth headset profile (HSP) or mobile phone ringtone) emitted from an external Bluetooth device (such as a mobile phone) (i.e. the wireless signal included in the judge signal) is detected by the receiver 24 (such as a Bluetooth module) can be determined. If the wireless signal emitted from the Bluetooth device is detected, then the method proceeds to step S428. If no wireless signal transmitted by the Bluetooth device is detected, then the method proceeds to step S404. In an embodiment, if no wireless signal transmitted by the Bluetooth device is detected, the method can enter step S430 or S436.

In step S428, the audio signal S2 is processed by the processor 22, and the mode of the speaker 14 is switched by a switch circuit (for example, the "loudspeaker mode" is switched to a "music mode" or a "notification mode"), such that the audio signal S2 is transmitted to the speaker 14 by the Bluetooth module of the receiver 24. Under the "loudspeaker mode", after the microphone 28 receives the audio signal S2, the processor 22 transmits the audio signal S2 to the speaker 14, so that the user can hear the environmental sound. Under the "music mode", the Bluetooth module of the receiver 24 receives the audio signal S2 and further transmits the audio signal S2 to the speaker 14, so that the usercan hear the music played by an external electronic device (such as a mobile phone equipped with a Bluetooth module). Under the "notification mode", the Bluetooth module of the receiver 24 receives the audio signal S2 and further transmits the audio signal S2 to the speaker 14, so that the user can hear the notification sound effect sent by an external electronic device (such as a mobile phone equipped with a Bluetooth module) and confirm whether the external electronic device has obtained new message (such as incoming call, short text message, e-mail, GPS information, calendar, or weather information). Or, after the Bluetooth module of the receiver 24 receives the wireless signal from the external electronic device, the electronic circuit of the processor 22 generates a notification sound effect to the speaker 14 to notify the user whether the external electronic device has received new message.

In step S430, whether the receiver 24 is equipped with a Wi-Fi module is determined by the processor 22. If the receiver 24 is equipped with a Wi-Fi module, then the method proceeds to step S432. If the receiver 24 is not equipped with a Wi-Fi module, then the method returns to step S404.

In step S432, whether a Wi-Fi signal (emitted from such as a hot point provided by a store) is detected by the receiver 24 (Wi-Fi module) is determined. If an external Wi-Fi signal is detected by the Wi-Fi module of the receiver 24, then the method proceeds to step S434. If no external Wi-Fi signal is detected by the Wi-Fi module of the receiver 24, then the method returns to step S404.

In step S434, the Wi-Fi module of the receiver 24 can be connected to the external wireless network and can further be connected to a remote server (such as a cloud or an intelligent terminal), such that the audio signal S2 can be transmitted to the speaker 14 from the Wi-Fi module. When the remote server has a new event, the audio signal S2 can be transmitted to the Wi-Fi module of the receiver 24 from the remote server and can further be transmitted to the speaker 14 from the Wi-Fi module to remind the user that the remote server already has an event. Or, when the Wi-Fi module of the receiver 24 detects that the remote server has an event, the processor 22 can transmit a prompt sound effect to the speaker 14 to remind the user.

In step S436, whether the receiver 24 is equipped with an IoT module is determined by the processor 22. If the receiver 24 is equipped with an IoT module, then the method proceeds to step S438. If the receiver 24 is not equipped with an IoT module, then the method returns to step S404. The IoT module can be realized by various wireless modules. For example, the IoT module can realized by a LoRa module, a SimpleLink module, a long term evolution (LTE) module, and a worldwide interoperability for microwave access (WIMAX) module, or a IoT wireless standard.

In step S438, whether an external IoT signal is detected by the receiver 24 (an IoT module) is determined. If an external IoT signal is detected by the IoT module of the receiver 24, then the method proceeds to step S440. If no external IoT signal is detected by the IoT module of the receiver 24, then the method returns to step S404.

In step S440, the IoT module of the receiver 24 can be connected to an external wireless network (such as an IP address) to process the audio signal S2 according to the external IoT signal (emitted from such as a remote IoT device) and then transmit the processed signal to the speaker 14. In an embodiment, when the receiver 24 includes a wireless module 246, the wireless module 246 can be realized by a Bluetooth module, a Wi-Fi module, an IoT module, other type of wireless module or a combination thereof, the processor 22 can perform an "IoT mode". Under the "IoT mode", the receiver 24 can be connected to an Internet or an Intranet to receive a signal from a remote server (such as a cloud or an intelligent terminal) or a remote IoT device and notify the user whether the remote device has an event. Besides, the IoT module of the receiver 24 can be connected to the external wireless network to obtain a linking signal of the location of the user (such as an IP address). The processor 22 automatically determines the location of the audio electronic device 100 (such as home, office, country side, cinema, crowd, or factory) according to the linking signal, and process the audio signal S2 to adjust the sound to a suitable play mode, so that the user can hear the needed sound. The location of the audio electronic device 100 can be obtained from the calendar information of the external electronic device 200 or the remote server 300, the global positioning system (GPS) signal, or any other positioning information (such as combined with the map information). For example, the location of the audio electronic device 100 can be obtained from the map information or the calendar information at a particular time. In an embodiment, the processor 22 includes an equalizer, and after the processor 22 obtains the location of the audio electronic device 100, the processor 22 can optimize the sound using the equalizer. For, the equalizer can change the sound play mode to different modes such as rock music mode, pop music mode, dance music mode, classical music mode, soft music mode, or film viewing mode. For example, when the processor 22 automatically determines that the user wearing the audio electronic device 100 is watching movie in a cinema, the microphone 28 receives and converts the sound of the movie into an audio signal S2, and the processor 22 further adjusts the audio signal S2 to a movie viewing mode (for example, the low-frequency sound is enhanced), such that the user can enjoy the sound effect of the movie.

In the present embodiment, the audio electronic device 100 includes a pressure sensor 242. However, the present disclosure is not limited thereto. In some embodiments, the audio electronic device 100 does not have to include the pressure sensor 242, and step S416 can be performed directly after step S404. That is, the steps between S404 and S416 are omitted.

An audio electronic device and an operating method thereof are provided according to the embodiments of the present disclosure. Since the processor of the audio electronic device can automatically process an audio signal according to a judgment signal, the user wearing the audio electronic device does not need to repeat the process of wearing and unplugging the audio electronic device, and can switch the sound play mode without manual operation. The audio electronic device can automatically detect the needed sound play mode and provide better convenience and auditory enjoyment to the user.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An audio electronic device, comprising:

a front structure, comprising an embedded body and a speaker, wherein the speaker is connected to the embedded body, and the embedded body is inserted in an ear;

a rear structure connected to the front structure, wherein the rear structure comprises:

a processor electrically connected to the speaker;

a receiver used for receiving a judgment signal, wherein the processor processes an audio signal according to the judgment signal; and a power supply;

wherein the receiver is electrically coupled to a pressure sensor, and the judgment signal comprises an environmental signal, the environmental signal represents a pressure, and if the pressure is greater than 1 atm, then the speaker is switched to a mute mode, if the pressure is not greater than 1 atm, then the speaker is switched to a loudspeaker mode, and in the mute mode, the processor switches off the audio signal from being transmitted to the speaker;

wherein a time duration for which the receiver detects the pressure is a first default time, if the pressure is equivalent to or less than 1 atm, then a time duration for which the receiver detects the pressure is a second default time, and the first default time is smaller than the second default time.

2. The audio electronic device according to claim 1, wherein the processor comprises a conversion circuit for switching a mode of the speaker according to the judgment signal.

3. The audio electronic device according to claim 1, wherein the rear structure further comprises a microphone used for receiving the audio signal.

4. The audio electronic device according to claim 1, wherein the processor comprises:

a wireless charging circuit;

a control logic circuit; and an integrated circuit board.

5. The audio electronic device according to claim 1, wherein the front structure and the rear structure are wrapped by a waterproof material, and the waterproof material further comprises a microporous structure.

6. An operating method of an audio electronic device, comprising:

receiving a judgment signal by a receiver;

receiving an audio signal by a microphone; and processing the audio signal by a processor according to the judgment signal to determine a mode under which the audio signal is transmitted to a speaker;

wherein the judgment signal comprises an environmental signal, the environmental signal represents a pressure, and if the pressure is greater than 1 atm, then the speaker is switched to a mute mode, if the pressure is not greater than 1 atm, then the speaker is switched to a loudspeaker mode, and in the mute mode, the processor switches off the audio signal from being transmitted to the speaker;

wherein a time duration for which the receiver detects the pressure is a first default time, if the pressure is equivalent to or less than 1 atm, then a time duration for which the receiver detects the pressure is a second default time, and the first default time is smaller than the second default time.

7. An operating method of an audio electronic device, comprising:

receiving a judgment signal by a receiver; and determining a mode under which an audio signal is transmitted to a speaker by a processor according to the judgment signal;

wherein the judgment signal comprises an environmental signal, the environmental signal represents a pressure, and if the pressure is greater than 1 atm, then the speaker is switched to a mute mode, if the pressure is not greater than 1 atm, then the speaker is switched to a loudspeaker mode, and in the mute mode, the processor switches off the audio signal from being transmitted to the speaker;

wherein a time duration for which the receiver detects the pressure is a first default time, if the pressure is equivalent to or less than 1 atm, then a time duration for which the receiver detects the pressure is a second default time, and the first default time is smaller than the second default time.

8. The operating method of an audio electronic device according to claim 7, further comprises:

receiving the judgment signal from an intelligent terminal or a cloud by the receiver.

* * * * *